US010060071B1

(12) United States Patent
Pierre

(10) Patent No.: US 10,060,071 B1
(45) Date of Patent: Aug. 28, 2018

(54) CLOTHES SAVER

(71) Applicant: Jean Claude Pierre, Brooklyn, NY (US)

(72) Inventor: Jean Claude Pierre, Brooklyn, NY (US)

( * ) Notice: Subject to any disclaimer, the term of this patent is extended or adjusted under 35 U.S.C. 154(b) by 0 days.

(21) Appl. No.: 15/430,485

(22) Filed: Feb. 11, 2017

Related U.S. Application Data

(60) Provisional application No. 62/294,460, filed on Feb. 12, 2016.

(51) Int. Cl.

| | |
|---|---|
| ***A47G 29/087*** | (2006.01) |
| ***D06F 53/02*** | (2006.01) |
| *A47G 25/06* | (2006.01) |
| *A47K 10/08* | (2006.01) |

(52) U.S. Cl.
CPC ..... *D06F 53/02* (2013.01); *A47G 25/06* (2013.01); *A47K 10/08* (2013.01)

(58) Field of Classification Search
CPC ..... D06F 53/00; D06F 53/02; A47K 10/08; A47G 25/06
USPC ..... 211/119.01–119.03, 119.1–119.13, 85.3
See application file for complete search history.

(56) References Cited

U.S. PATENT DOCUMENTS 416,854 A * 12/1889 Percival ..... D06F 53/02 211/119.14
451,065 A * 4/1891 McKay ..... D06F 53/02 211/119.13
457,121 A * 8/1891 Kimmel ..... D06F 55/00 211/119.13
457,617 A * 8/1891 Moore ..... D06F 53/02 211/119.14
532,242 A * 1/1895 McShane ..... A45F 3/04 211/119.12
551,045 A * 12/1895 Phelps ..... D06F 53/02 211/119.13
559,925 A * 5/1896 Ayres ..... D06F 53/02 211/119.13
561,142 A * 6/1896 Sterzing ..... D06F 53/02 211/119.14
581,152 A * 4/1897 French ..... A47G 25/485 211/119.13
582,927 A * 5/1897 Johnson ..... D06F 53/02 211/119.13
610,906 A * 9/1898 Jackson ..... D06F 53/02 211/119.14
687,538 A * 11/1901 O'Neill ..... D06F 53/02 211/119.12

(Continued)

FOREIGN PATENT DOCUMENTS

CN 203144760 * 8/2013
CN 203212879 * 9/2013

*Primary Examiner* — Jonathan Liu
*Assistant Examiner* — Devin K Barnett
(74) *Attorney, Agent, or Firm* — RG Patent Consulting, LLC; Rachel Gilboy

(57) ABSTRACT

A specially designed clothes line, with an integrated "hanger line," that features a series of "V" shaped hanger holders which allow garments to be suspended via a hanger, in its own space to provide an easier and more effective means of attending to laundry chores and clothing management by providing a neater, more secure, and space-saving means of air drying laundry, while eliminating the hassles of clothes-pins.

2 Claims, 2 Drawing Sheets

(56) References Cited

U.S. PATENT DOCUMENTS 693,401 A * 2/1902 Johnson ..... D06F 53/02 211/119.13
696,234 A * 3/1902 Gornston ..... D06F 53/02 211/119.03
718,086 A * 1/1903 Brown ..... D06F 53/02 211/119.13
763,309 A * 6/1904 Moye ..... D06F 53/02 211/119.14
820,615 A * 5/1906 Barnette ..... D06F 53/02 211/119.13
839,402 A * 12/1906 Montgomery ..... D06F 53/02 211/119.13
1,042,345 A * 10/1912 Henderson ..... D06F 53/02 211/119.14
1,055,055 A * 3/1913 LaHay ..... D06F 53/02 211/119.14
1,057,119 A * 3/1913 Cochrane ..... D06F 53/02 211/119.14
1,141,728 A * 6/1915 Sell ..... D06F 55/00 211/119.13
1,168,102 A * 1/1916 Nelson ..... D06F 53/02 211/119.14
1,211,312 A * 1/1917 Heasley ..... D06F 53/02 211/119.13
1,214,469 A * 1/1917 Irvin ..... D06F 53/02 211/119.14
1,217,030 A * 2/1917 Long ..... B61B 12/002 105/150
1,336,186 A * 4/1920 Baron ..... D06F 53/02 211/119.1
1,350,380 A * 8/1920 Nelson ..... D06F 53/02 211/119.13
1,360,189 A * 11/1920 Cushing ..... D06F 53/02 211/119.13
1,360,846 A * 11/1920 Williams ..... D06F 53/00 211/119.15
1,365,264 A * 1/1921 Myers ..... D06F 53/04 211/119.1
1,521,987 A * 1/1925 Belfranci ..... D06F 57/00 211/119.12
1,633,722 A * 6/1927 Alexander ..... D06F 53/00 24/129 R
1,793,417 A * 2/1931 Roberts ..... A44C 5/14 211/119.12
1,820,706 A * 8/1931 Law ..... D06F 53/02 211/119.14
1,882,126 A * 10/1932 Eldridge ..... D06F 53/02 211/119.14
1,960,882 A * 5/1934 Turner ..... D06F 53/02 211/119.14
2,103,642 A * 12/1937 Roller ..... A47B 61/003 211/85.3
2,114,424 A * 4/1938 Jesse ..... A47F 7/19 211/85.3
2,120,511 A * 6/1938 Risdon ..... A47F 7/24 211/123
2,144,963 A * 1/1939 Darlington ..... D06F 53/00 135/119
2,188,937 A * 2/1940 Bertram ..... D06F 53/00 24/135 L
2,213,376 A * 9/1940 Bauer ..... D06F 53/02 211/119.11
2,245,729 A * 6/1941 Snyder ..... D06F 53/02 211/119.13
2,260,560 A * 10/1941 Coleman ..... D06F 53/02 211/119.12
2,283,987 A * 5/1942 Hammar ..... D06F 53/04 211/119.1
2,289,710 A * 7/1942 Kelso ..... D06F 53/02 174/DIG. 12
2,318,375 A * 5/1943 Copeman ..... D06F 53/02 2/266
2,360,458 A * 10/1944 Wentz ..... A47B 61/003 211/119.1
2,505,890 A * 5/1950 Fredrick ..... D06F 53/02 211/119.14
2,508,491 A * 5/1950 Cayo ..... D06F 53/02 211/119.01
2,520,511 A * 8/1950 Ruyle ..... D06F 53/02 211/119.14
2,526,285 A * 10/1950 Schuyler ..... B60R 7/10 211/123
2,530,324 A * 11/1950 Bumbera ..... D06F 53/02 211/119.1
2,535,640 A * 12/1950 Levine ..... D06F 55/00 211/119.13
2,595,817 A * 5/1952 Sebade ..... D06F 53/02 211/119.14
2,676,711 A * 4/1954 Jardim ..... D06F 53/02 211/119.02
3,085,691 A * 4/1963 Smith ..... A47F 7/24 211/113
3,127,019 A * 3/1964 Von Meyer ..... D06F 53/02 211/119.13
3,147,865 A * 9/1964 Zimmerli ..... A47G 25/1478 211/119
3,190,455 A * 6/1965 Hartshorn ..... D06F 53/02 211/119.03
3,193,235 A * 7/1965 Jensen ..... A47G 25/1478 211/119.12
3,391,491 A * 7/1968 Daly ..... A01G 17/06 211/119.01
3,675,785 A * 7/1972 Martin ..... D06F 53/04 211/119.1
3,750,891 A * 8/1973 Decorato ..... D06F 53/02 211/119.02
4,091,857 A * 5/1978 Jacobs ..... A47H 1/18 160/330
4,335,422 A * 6/1982 Van Ess ..... F21S 4/10 362/249.01
4,833,759 A * 5/1989 Larsen ..... A47G 25/1478 223/85
5,272,834 A * 12/1993 Jarahian ..... A01G 17/06 211/119.01
5,393,027 A * 2/1995 Koval ..... D06F 53/04 211/119.01
6,196,399 B1 * 3/2001 Pacheco ..... A47G 25/1478 211/113
6,257,418 B1 * 7/2001 Allen ..... G09F 7/18 211/1.3
6,454,109 B1 * 9/2002 Doyle ..... D06F 53/00 211/119.01
6,899,256 B2 * 5/2005 Richter ..... B60R 7/02 211/119.1
7,832,574 B1 * 11/2010 Sexton ..... A47G 25/0664 211/195
7,878,342 B1 * 2/2011 Lewis ..... D06F 53/04 211/119.01
2004/0089624 A1 * 5/2004 Farley ..... D06F 53/00 211/119.03
2010/0300998 A1 * 12/2010 Plante ..... D06F 53/04 211/85.3
2011/0036795 A1 * 2/2011 Nimon ..... A47B 47/0091 211/85.3
2011/0198308 A1 * 8/2011 Keylikhes ..... A47G 25/485 211/119.12
2012/0285913 A1 * 11/2012 Taurins ..... A47G 25/74 211/85.3
2013/0186846 A1 * 7/2013 Raghunathan ..... D06F 53/04 211/119.01
2015/0008201 A1 * 1/2015 Qiang ..... A47F 7/24 211/85.3
2016/0120351 A1 * 5/2016 Davis ..... A47G 25/746 211/85.3
2017/0181540 A1 * 6/2017 Edwards ..... A47B 61/02

* cited by examiner

CLOTHES SAVER

CROSS-REFERENCE TO RELATED APPLICATION

The present application is related to and claims priority from prior provisional application Ser. No. 62/294,460, filed Feb. 12, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of clothesline hanger holders and more specifically relates to a specially designed clothes line, with an integrated "hanger line," that features a series of "V" shaped hanger holders which allow garments to be suspended via a hanger, in its own space to provide an easier and more effective means of attending to laundry chores and clothing management by providing a neater, more secure, and space-saving means of air drying laundry, while eliminating the hassles of clothespins.

2. Description of the Related Art

Cleaning dirty laundry has been a necessary household chore ever since man first donned body covering material. In earlier times, washing clothes was basically an act of dunking the items in a local stream, beating them against a nearby flat rock, and wringing them out by hand to dry. After the discovery of soap, the cleaning of laundry became much easier and more effective. According to Roman legend, soap got its name from Mount Sapo, where animals were regularly sacrificed. Rain washed a mixture of melted animal fat and wood ashes down the mountain and into the clay soil along the Tiber River. Women washing clothes in this area of the river found that the mixture of clay, animal fat and ash made their wash cleaner, and with much less effort. From ancient times to current times, having a pile of dirty laundry to wash is just one of those unavoidable conditions experienced in active households. Modern washing machines have taken much of the drudgery out of clothes washing, but dirty clothing must still be collected from the hamper, brought to the washer, taken from the washer and placed in a dryer.

Despite the widespread use of electric-powered and gas-powered clothes dryers, many families find that it is more cost-effective to air-dry garments by hanging them on a clothesline. Not only does this practice save money and conserve energy, but there is an unmistakable fresh scent to clothing and linens dried in the sunshine on an outdoor clothesline. In addition, many materials can be damaged by the intense heat of a dryer, so it is typically best to allow such clothing to be air dried. To facilitate the attachment of garments to an outside line, consumers employ clothespins, or fastening clips made of wood or plastic. However, as necessary as clothespins can be, there are drawbacks associated with their use. Particularly, the pinching clip portion of wooden pins can leave behind dark marks on garments and linens, necessitating the rewashing of these items.

While using the plastic variety of pins alleviates this problem, plastic tends to break down after extended exposure to the elements, as the heat of the sun can soon render them brittle. Additionally, clothespins are often not strong enough to keep clothing secured to a line; should a stiff wind blow, consumers find that their clean garments have come loose from the line and have landed in a heap in dirt and mud. Lastly, even when clothes are secured, it is necessary to spread them out in order to ensure optimal drying with little to no wrinkles. As can be imagined, this takes up copious room on clotheslines, with consumers unable to hang all of their laundry at once.

Various attempts have been made to solve problems found in clothesline hanger holders art. Among these are found in: U.S. Pat. No. 3,750,891 to Frank Decorato; U.S. Patent No. 2011/0198308 to Lidia Keylikhes; and U.S. Pat. No. 3,085,691 to Josephine C. Smith. This prior art is representative of clothesline hanger-holding devices with integral separators. None of the above inventions and patents, taken either singly or in combination, is seen to describe the invention as claimed.

Ideally, a clothesline hanger should provide convenient means for efficiently drying clothes and, yet would operate reliably and be manufactured at a modest expense. Thus, a need exists for a reliable Clothes Saver, a specially designed clothes line, with an integrated "hanger line," that features a series of "V" shaped hanger holders which allow garments to be suspended via a hanger, in its own space to provide an easier and more effective means of attending to laundry chores and clothing management by providing a neater, more secure, and space-saving means of air drying laundry, while eliminating the hassles of clothespins and to avoid the above-mentioned problems.

BRIEF SUMMARY OF THE INVENTION

In view of the foregoing disadvantages inherent in the known clothesline hanger holder art, the present invention provides a novel Clothes Saver. The general purpose of the present invention, which will be described subsequently in greater detail is to provide a specially designed clothes line, with an integrated "hanger line," that features a series of "V" shaped hanger holders which allow garments to be suspended via a hanger, in its own space to provide an easier and more effective means of attending to laundry chores and clothing management by providing a neater, more secure, and space-saving means of air drying laundry, while eliminating the hassles of clothespins.

As discussed above, embodiments of the present invention relate to a clothesline hanger holder and more particularly to a Clothes Saver, a specially designed clothes line, with an integrated "hanger line," that features a series of "V" shaped hanger holders which allow garments to be suspended via a hanger, in its own space to provide an easier and more effective means of attending to laundry chores and clothing management by providing a neater, more secure, and space-saving means of air drying laundry, while eliminating the hassles of clothespins.

In addition to revolutionizing time, space, and security concerns when it comes to laundry, several other advantages are germane to the Clothes Saver. A universal clothes line that is vastly improved from the common design, this product would be ideal for use in large backyards, on tiny terraces, or even inside a laundry room. Easily installed in any chosen area, the Clothes Saver would be ready for use in a matter of seconds.

As laundry is removed from the wash, each garment need only be hung on a waiting hanger, and then simply suspended on the line via the creative "Vs". Instead of having to stretch garments along a line and secure them with clothespins, users would be able to reduce the space between clothes to a compact 2½ inches, facilitating the hanging of more garments while still leaving room for suspending larger items such as sheets and blankets over the line, like one would normally do. Able to fully optimize the freshness inherent in drying clothes in the outside air, the Clothes Saver would eliminate the hassles inherent in dependence on clothespins, such as the marking of clothes and inefficient security. With this product, users need not worry that their laundry will fall from the line. And, since garments are already neatly hung on a hanger, the product would end the arduous process of unpinning, gathering, and then putting clothes away. With the Clothes Saver, users need only grab each hanger and place the garments directly into a closet, reducing time and labor spent managing laundry.

Combining form with function, the Clothes Saver is a unique product invention that would offer consumers optimal laundry convenience. Providing ample storage and durability, this cleverly designed accessory would facilitate the task of doing laundry in a quick and easy manner.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Clothes Saver, which is constructed and operative according to the teachings of the present invention.

The various embodiments of the present invention will hereinafter be described in conjunction with the appended drawings, wherein like designations denote like elements.

DETAILED DESCRIPTION

Figure 1:
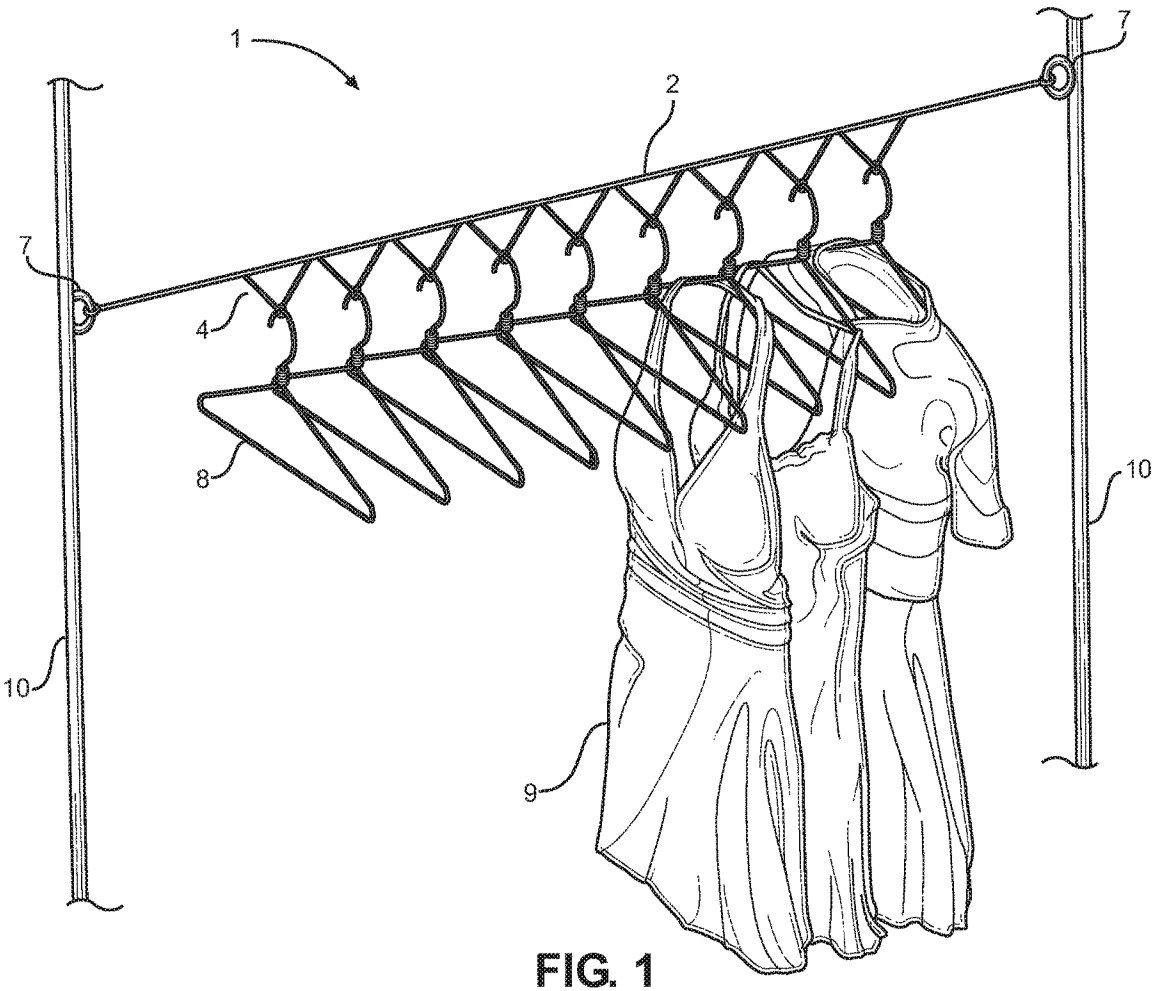
FIG. 1 shows a perspective view illustrating a Clothes Saver in use according to an embodiment of the present invention.
Figure 2:
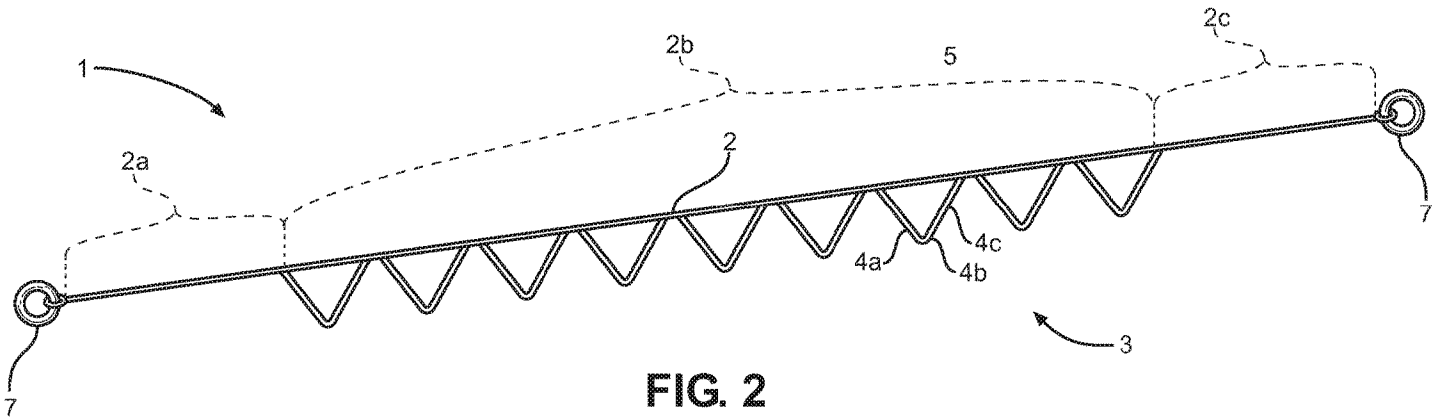
FIG. 2 is a perspective view illustrating a Clothes Saver according to an embodiment of the present invention of FIG. 1.
Figure 3:
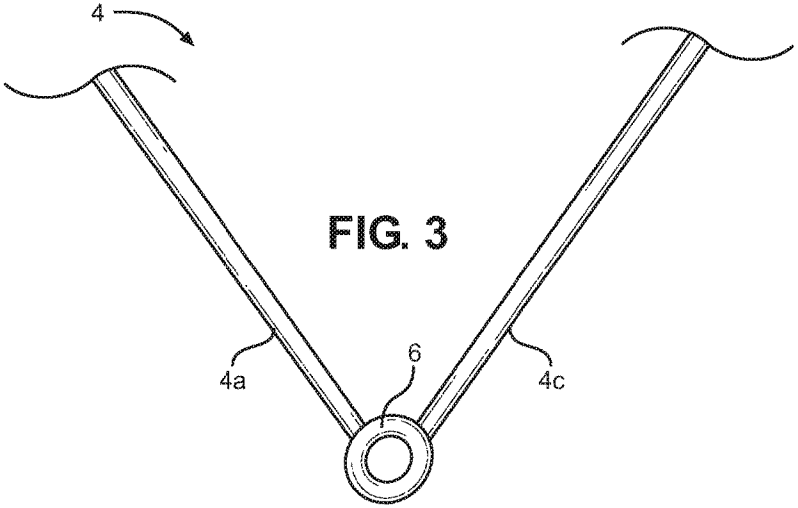
FIG. 3 is a close up view illustrating the eyelet of the embodiment of the present invention of FIG. 1.

Referring to the drawings by numerals of reference there is shown in FIG. 1-3, the Clothes Saver comprising a novel product offering consumers a practical solution to the aforementioned challenges. As the name implies, the Clothes Saver comprises a specially designed augmented clothesline 1 that is designed to allow garments to be suspended via a hanger. In this manner, users would be able to maximize clothesline space, eliminate the hassles of clothespins, and simply transfer garments directly from the clothesline 1 to the closet.

Offered in lengths ranging from twenty-five to fifty feet (25'-50'), the Clothes Saver clothesline 1 would be a dual line; the main line 2, with a linear construct, is fashioned of a durable nylon material that is approximately three-sixteenth of an inch (3/16") in diameter. The main line 2 extends along a longitudinal axis. Referring now to FIG. 2, the main line 2 consists of a left mounting portion 2*a*, a middle mounting portion 2*b* and a right mounting portion 2*c*. The left mounting portion 2*a* extends longitudinally outward from and contiguous with the main line 2 by which the clothesline 1 is mounted perpendicular to a vertical support 10 on the left side when viewed from the front. The middle mounting portion 2*b* of the main line 2 is contiguous with the left mounting portion 2*a* and the right mounting portion 2*c*. The middle mounting portion 2*b* is the portion of the main line 2 upon which a hanger line 3 is suspended. The right mounting portion 2*c* extends longitudinally outward from and contiguous with the main line 2 by which the clothesline 1 is mounted perpendicular to a vertical support 10 on the right side when viewed from the front.

The hanger line 3 is a continuous run line and extends below and is suspended by the main line 2 at a series of connection points 5 as will be described hereinafter. The hanger line 3 consists of a series of "V" shaped hanger holders 4 fashioned of cotton and measuring one quarter inch (¼") in diameter. The hanger holders 4 are approximately four inches (4") in length, with the spacing between the hangers 8 being two and one half inches (2½"). Each V-shaped hanger holder 4 consists of a first leg 4*a* which extends downward vertically from the main line 2 from a connection point 5 on the main line 2 at an angle of approximately 45 degrees from left to right towards a free hanging apex 4*b*. From the free hanging apex 4*b* a second leg 4*c* extends upward vertically at an angle of approximately 45 degrees from left to right to a connection point 5 on the main line 2.

The connection point 5 is made by either gluing, weaving or other similar equivalent fastening devices. The respective free hanging apexes 4*b* are not connected directly to one another by any further structure, such as an additional line or cord, so that the V-shaped hanger holders 4 hang freely from the main line 2. The ability of the V-shaped hanger holders 4 to be suspended from the main line 2 and allowed to hang freely without restraint permits the garment hangers 8 to find the center of gravity within the freely hanging apex 4*b*. In this way, the garment hangers 8 can be suspended in a more compact manner while still allowing a space to reside between the suspended garments 9 so they may more effectively dry in the air.

The clothesline 1 may further comprise eyelets 6 at the tip of the freely hanging apex 4*b* of the hanger holders 4. As shown in FIG. 3, the first leg 4*a* and the second leg 4*c* of the V-shaped hanger holders 4 define a vertical plane. The eyelet 6 is disposed within the freely hanging apex 4*b* and oriented so as to lie within the vertical plane as defined by the first leg 4*a* and the second leg 4*c*. The orientating of the eyelet 6 within the vertical plane allows the garment hangers 8 to be suspended from the eyelet 6 so the garment hangers 8 will be perpendicular to the longitudinal axis of the middle mounting portion 2*b* of the main line 2 permitting for a more compact and economical space saving arrangement. The eyelet 6 is a freely hanging circle and may be of the same material and integral with the V-shaped holders 4. Alternately, the eyelet 6 may be separate and attached to the tip of the bottom apex by gluing, weaving or other similar equivalent fastening devices. The eyelets 6 provide for additional stability in suspending the garments 9 from the garment hangers 8, particularly in windy conditions where the clothesline 1 is used outdoors. It should be noted that eyelet 6 is not necessary in clothesline 1 that will strictly be used indoors.

A mounting ring 7 is provided at the free end of the left mounting portion 2*a* and the right mounting portion 2*c* of the main line 2. The mounting ring 7 is used to mount the clothesline 1 to any convenient supporting structure such as a hook disposed on a vertical wall or to upstanding support posts 10. The mounting ring 7 may be a circle integral with the main line 2. Alternately, the mounting ring 7 may be made separate and of any suitably strong material able to withstand inclement weather and can be tied to the left mounting portion 2*a* and the right mounting portion 2*c* respectively, or fastened thereto in some other suitable manner.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

What is claimed is:

1. A clothesline for suspending garments comprising:

a main line;

a hanger line;

and a plurality of garment hangers;

said main line positioned above said hanger line in vertical spaced relation thereto and in the same plane therewith, said main line having a mounting ring at each end thereof for connection to a fixed vertical support respectively; said hanger line being suspended from said main line and comprising a series V-shaped hanger holders, each said V-shaped hanger holder being independently suspended from said main line, said V-shaped hanger holders each having a downwardly directed free hanging apex; and said V-shaped hanger holders each having a circular eyelet located at said free hanging apex; wherein the garment hangers are removably inserted in and suspended from said eyelets in a perpendicular orientation relative to the main line allowing for a more compact storage of garments to dry efficiently therefrom;

wherein said main line is made of a nylon material having a diameter of three-sixteenth of an inch, said hanger line is made of a cotton material having a diameter of one quarter of an inch and wherein the distance between each adjacent eyelet is two and one half inches such that a corresponding garment hanger from said plurality of garment hangers can be suspended in each eyelet.

2. The clothesline of claim 1 wherein said main line comprises a left mounting portion, a middle mounting portion and a right mounting portion, wherein said hanger line is suspended from said middle mounting portion.

* * * * *